United States Patent [19]

Pauty

[11] 3,955,276

[45] May 11, 1976

[54] ELECTRICALLY MOTOR DRIVEN CAN OPENER

[75] Inventor: Bernard Pauty, Quetigny, France

[73] Assignee: Societe Anonyme Etud, Dijon, France

[22] Filed: June 28, 1973

[21] Appl. No.: 374,783

[30] Foreign Application Priority Data

June 30, 1972 France ..... 72.23724
Jan. 3, 1973 France ..... 73.00118

[52] U.S. Cl. ..... 30/4 R
[51] Int. Cl.[2] ..... B67B 7/38
[58] Field of Search ..... 30/4 R, 8, 8.5, 9

[56] References Cited

UNITED STATES PATENTS

| | | | |
|---|---|---|---|
| 1,768,980 | 7/1930 | Haines | 30/8.5 |
| 2,070,279 | 2/1937 | Killman | 30/8.5 |
| 3,815,226 | 6/1974 | Marrie | 30/4 R |

FOREIGN PATENTS OR APPLICATIONS

| | | | |
|---|---|---|---|
| 1,943,022 | 4/1971 | Germany | 30/8.5 |

*Primary Examiner*—Al Lawrence Smith
*Assistant Examiner*—Gary L. Smith
*Attorney, Agent, or Firm*—Cushman, Darby & Cushman

[57] ABSTRACT

Electrically driven device for automatically opening food cans using a serrated wheel to turn the can and a fixed cutting element, consisting of an oscillating arm supporting the spindle of the serrated wheel and controlled in its movement by a cam, with a device for reversing the direction of operation in order to return to the rest position releasing the can after removal of the lid, characterised by the fact that the reversal device consists of a sleeve fixed coaxially on the shaft of the motor, the two ends of which are cones each fitting into a female cone, each female cone being hollowed out of a bevel pinion mounted loose on the shaft of the motor, and the two bevel pinions being meshed permanently with a bevel gear turning at right angles to the shaft of the motor and actuating the serrated wheel driving mechanism, the shaft being given an end play which enables a driving friction to be obtained between either of the conical ends of the sleeve and the enclosing female cone, and thus to reverse at will the operating direction of the device.

16 Claims, 21 Drawing Figures

FIG. 4
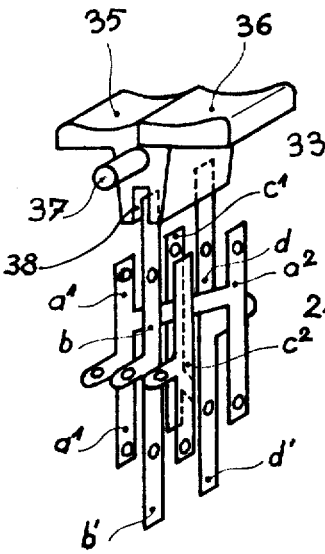
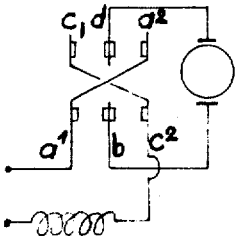
FIG. 5
FIG. 3
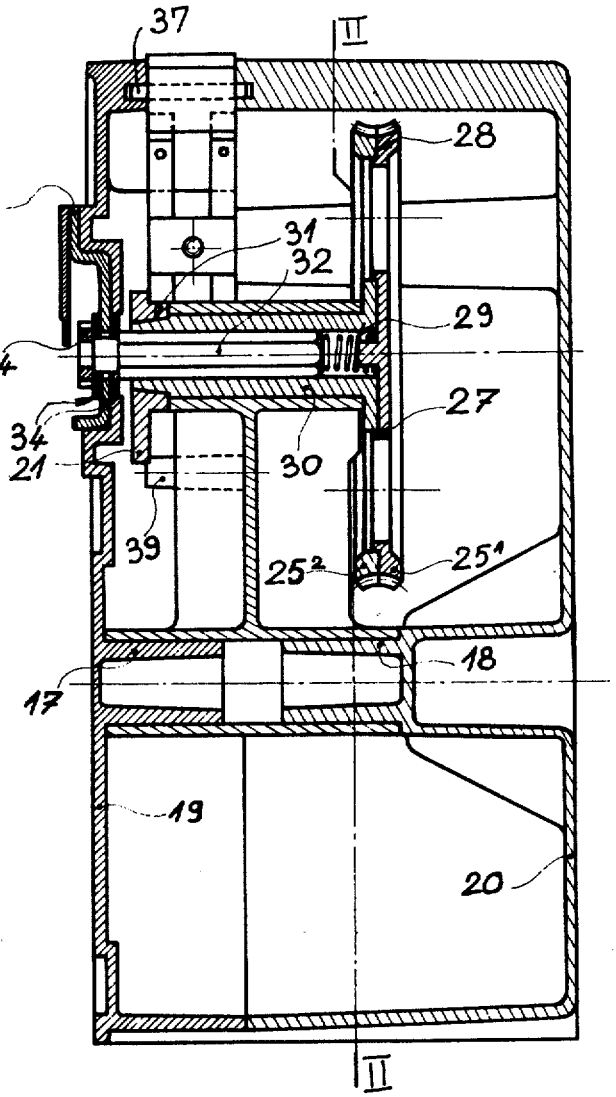

FIG. 7
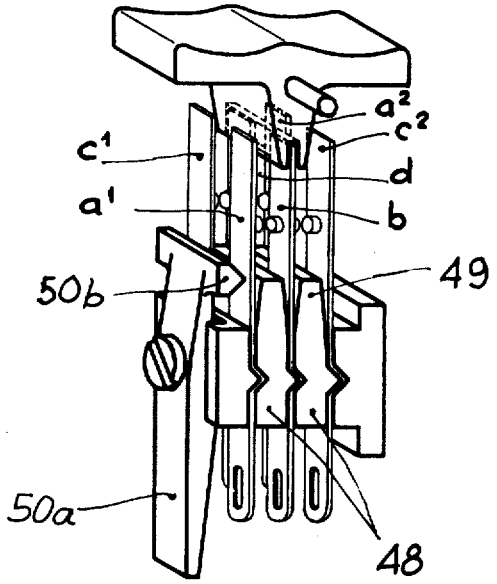
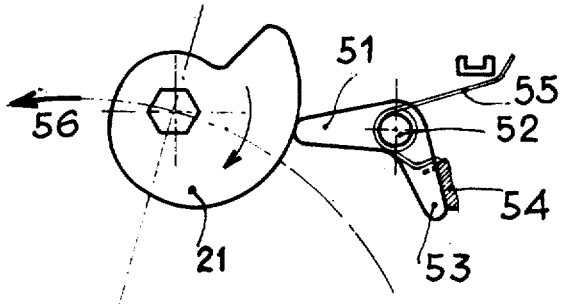
FIG. 8
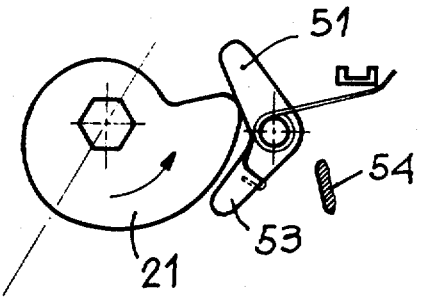
FIG. 9

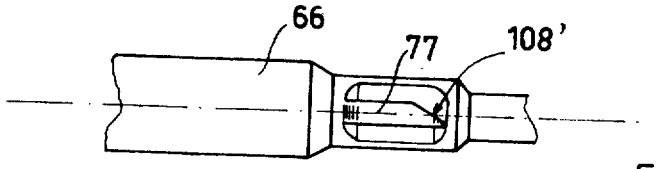
Fig. 13
Fig. 15
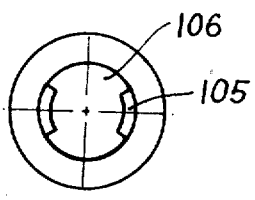
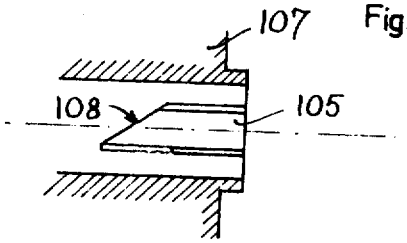
Fig. 14
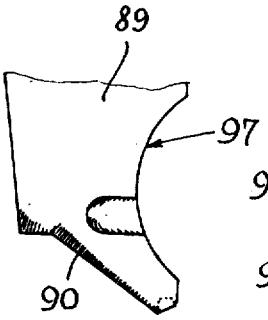
Fig. 18
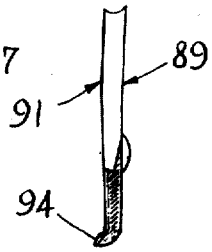
Fig. 19
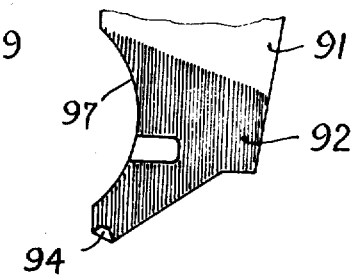
Fig. 20
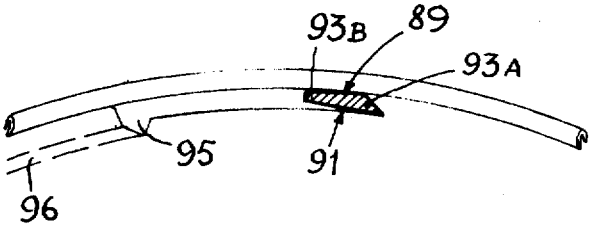
Fig. 16

ELECTRICALLY MOTOR DRIVEN CAN OPENER

CROSS REFERENCE TO RELATED APPLICATION

U.S. Application Ser. NO. now U.S. Pat. No. 3,815,226 discloses an electrically driven device for automatically opening food cans (using a serrated wheel to turn the can and a cutting element); this device consists of an arm which can oscillate at a fixed angle about a spindle fixed to the casing of the device, this arm, via a hollow driven component, carrying the shaft at the end of which is fixed the revolving serrated wheel turning the can to be opened, the movement of this arm being controlled by a suitably shaped cam working in combination with a stop pin so that the serrated wheel turning the can is raised along a short incline with automatic perforation of the lid of this can by the cutting element; then the lid is removed by rotation of the can, the rotor of the motor being connected to the gear train driving the cam and the serrated wheel shaft by means of automatic reversal of the operating direction, to return the cam and the serrated wheel, after removal of the lid, to their rest positions, releasing the can.

As an example, this earlier application proposed, in order to obtain automatic reversal of the operating direction, that the part of the spindle of the motor outside the motor itself should turn a sleeve with two horizontal end flanges, i.e. in the form of a bobbin, one of these flanges driving by friction a horizontal axis roller transmitting the movement to the gear train, reversal of the direction of rotation being produced by passage of the friction on the lower flange to friction on the upper flange. Such a friction system has a poor mechanical efficiency and rapid wear of the surfaces in contact occurs at the friction level.

OBJECT OF THE PRESENT INVENTION

The object of the present invention is to remedy these disadvantages and to this end two alternatives are proposed for the device for automatic reversal of the operating direction.

BRIEF SUMMARY OF THE PRESENT INVENTION

In one alternative, this device consists of a sleeve fixed coaxially onto the shaft of the motor, the two ends of which are cones each fitting into a female cone, each female cone being hollowed out of a bevel pinion mounted loose on the shaft of the motor, and the two bevel pinions being permanently meshed with a bevel gear turning at right angles to the shaft of the motor and actuating the serrated wheel drive mechanism, the shaft, as in the main patent, having an end play which enables a driving friction to be obtained between one of the conical ends of the sleeve and the female cone fitted over it, and therefore reversal at will of the operating direction of the device.

In a second alternative, this device is actuated electrically, the motor having two rotating directions; in particular this motor can be fitted with its reduction train on the oscillating arm, and the shaft of the motor drives a worm engaged with a gear to turn the serrated driving wheel.

FURTHER FEATURES OF THE PRESENT INVENTION

In the embodiments in the earlier application and the alternatives given above, the insertion of the cutting element into the lid of the can to be opened is achieved by raising the serrated wheel turning the can towards the cutter which is fixed. This movement is controlled by the action of a cam. The open can may therefore be released only by reversing the direction of rotation of the serrated wheel.

It became apparent in use that the user is apprehensive of this automatic operation, and that use of the device demands a certain working knowledge. The housewife accepts more readily a can opener with a movable cutter descending into the lid to be removed, than a fixed cutter device in which the can comes up to meet the cutter.

To reduce these commercial disadvantages whilst retaining the practical characteristics of the above mentioned alternatives, in particular instantaneous dismantling of the cutting head, the present invention proposes the combination of the principle of lever type can openers and the system enabling the active part of the machine to be dismantled, an assembly which it must for elementary hygiene requirements be possible to dismantle easily for cleaning purposes.

The inherent defect in the lever system lies in the need to exercise a substantial manual effort in order to engage the cutter in the lid of the can to be opened, and to maintain this effort throughout the removal operation. The present invention reduces this disadvantage.

The present invention therefore also relates to an electrically driven device for automatically opening food cans, comprising, on a fixed platen, a positioning stop for the rim of the can, a serrated driving wheel to turn the can, and a lever which starts the device by descending onto an electric contact maker, and also in the same movement positions the end of the cutter edge on the lid of the can to be opened. The end of the serrated wheel holder shaft engages in a hollow driving component. This device is characterised in particular by the fact that, in order to reduce the effort for the cutter to penetrate the lid of the can to be opened, this cutter is fitted in a mobile position on the same spindle as the lever and has, with respect to the latter, a free rotation sector, and by the fact that an elastic component pressing the rim on the wheel is mobile on the same spindle along a sector of fixed angular value, and is pulled by the cutter when it itself is turning. The free rotation of the cutter is limited in the "removal" position by it engaging and locking in an angle locked to the platen. The free rotation sector of the cutter with respect to the lever also enables the rotation of the can to be stopped, leaving the cutter in the angle which has the affect of holding the can on the machine.

Thus the force to engage the cutter and maintenance of this force are obtained through the device itself. The device is particularly characterised by the fact that removal of the lid from the can is perfectly clean and free from rough edges thanks to a special sharpening of the cutter bearing on the one hand on the rear face coming in contact with the rim and on the other hand on the front face in such a way that this cutter is backed off with respect to the cut edge of the lid.

BRIEF DESCRIPTION OF DRAWINGS

In the attached drawings given as non-limitative examples:

FIG. 3 is a vertical section along the line III—III in FIG. 2.

FIG. 4 is a view in perspective of the electric reversing attachment of the device according to FIGS. 2 and 3.

FIG. 5 is a circuit diagram of the motor of this device.

FIG. 7 is a view in perspective of an alternative electric reversing attachment for the device.

FIGS. 8 and 9 are views showing the mode of operation of a pivoting stop working in combination with the cam controlling the movement of the oscillating arm.

FIG. 13 is a front view showing the flattening of the metal on the serrated wheel spindle.

FIG. 14 is a sectional view of the driving hub.

FIG. 15 is a front view of the driving hub on the serrated wheel spindle engagement side.

FIG. 16 is a section of the cutter taken to the right of the cutting edge on a level with the cutting plane, with the lid and rim of the can being opened shown by a thin continuous line.

FIGS. 18, 19 and 20 are rear, profile and front views of the end of the cutter.

DESCRIPTION OF EMBODIMENTS

Figure 1:
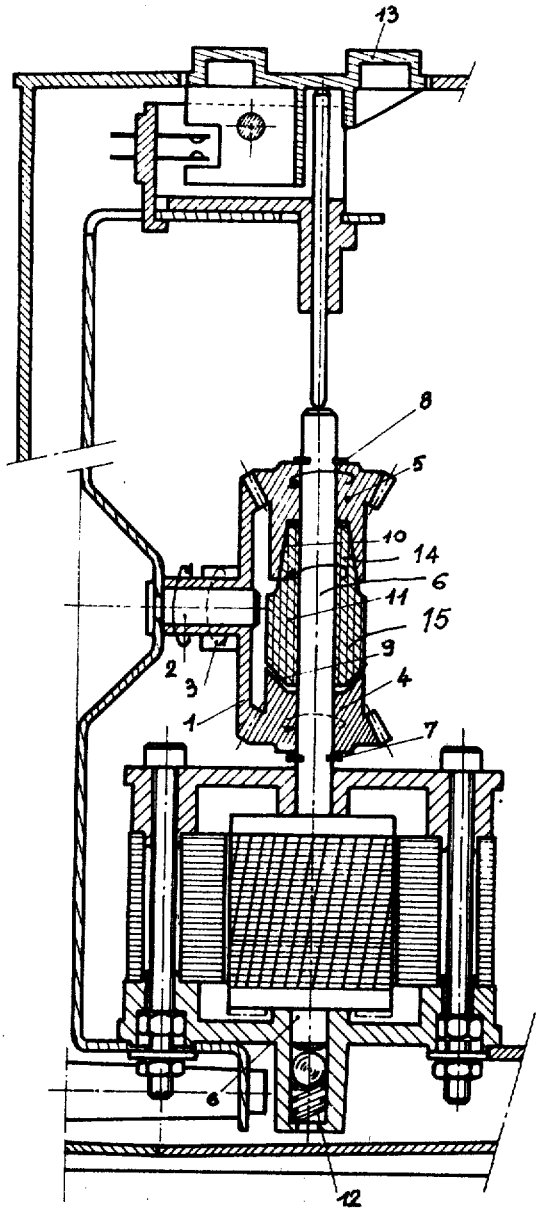
FIG. 1 is a vertical section of a device according to the first alternative through a plane passing through the spindle of the motor and showing the reversal attachment.

As shown in FIG. 1, the shaft 6 of the motor is capable of end play against a spring 12 under the effect of a reversing switch the reversing key of which is shown at 13, in the conditions set out in the above referred related patent.

A sleeve 11 ending in two tapered elements 14 and 15 is fixed coaxially onto the driving shaft 6; the cone 14 fits into a female cone 10 of the same taper hollowed out of a bevel pinion 5 fitted loose on the shaft 6; the same applies to the lower cone which fits into the female cone 9 of the same taper hollowed out of the bevel pinion 4 also loose on the shaft; the two bevel pinions mesh permanently with a bevel gear 1 rotating about a spindle 2 at right angles to the shaft 6. This bevel gear 1 has a pinion 3 transmitting the movement to the other gears.

The two bevel pinions 5 and 4 are held axially by the two circlips 8 and 7; the cones 10 and 14 have a tighter angle than the cone 9 and 15 and when stationary, the upper cones are normally engaged, whilst there is clearance between the two lower cones the angle of which is about 90°.

If the motor is started, the sleeve 11 turns and drives the pinion 5, in the direction of the arrow for example, and the gear 1 with the pinion 3 turns in the direction of the continuous line arrow. Under the effect of the spring 12 and the slow taper of the cones (10, 14), the friction joint is practically non-slip.

With the motor still running in the same direction, if the reversing key 13 is pressed, the driving shaft moves down and the friction joint is moved from the two cones 10, 14 to the two cones 9, 15; the pinion 4 turns in the same direction as the shaft, and the gear 1 with the pinion 3 turns in the opposite direction from before (dotted arrow). The taper given to the cones 15 and 9 give a drive with some slip which avoids sudden stalling of the motor when the cam which engages the cutter comes to a stop at the time of the can release movement.

This conical surface connection provides better resistance to wear; the mechanical effeciency of such a coupling is good.

Figure 2:
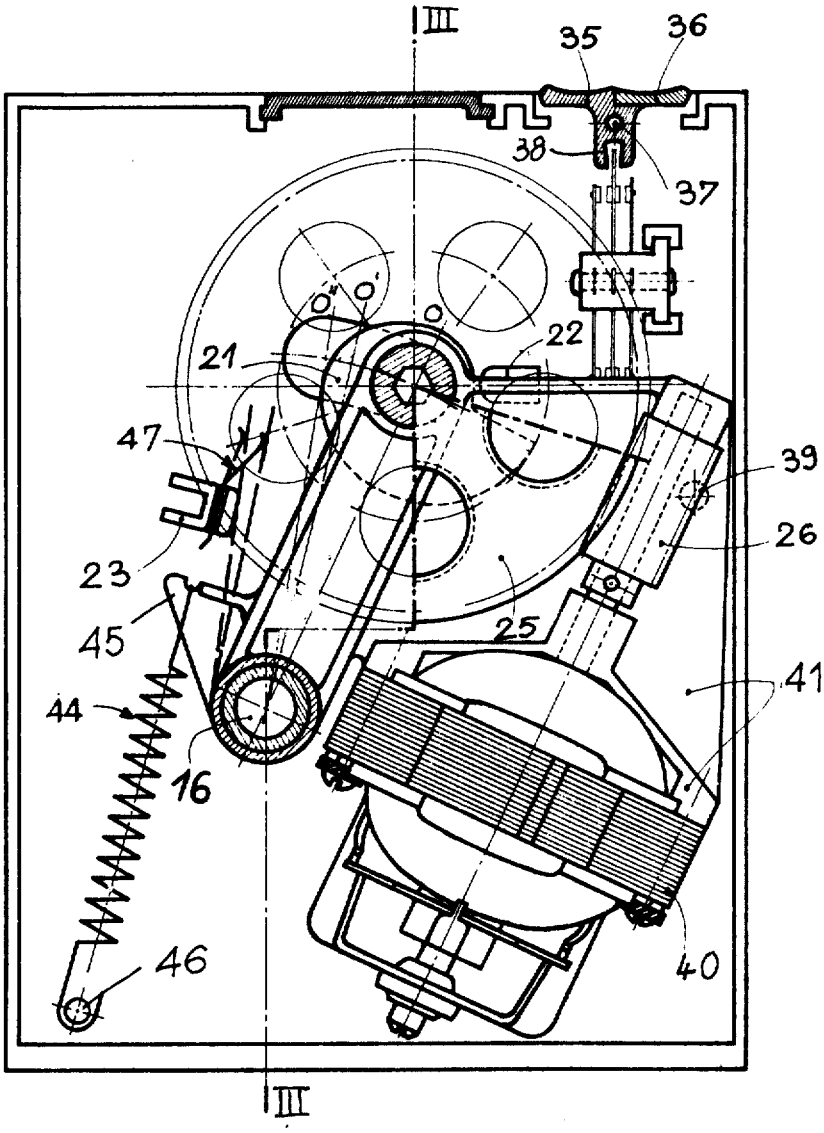
FIG. 2 is an elevation of a device according to the second alternative with a vertical section along the line II—II in FIG. 3.

Given that in the alternative in FIGS. 2 and 3, the reversal of operation is achieved by reversal of the direction of rotation of the motor, the kinematics are very much simplified and the reliability of the device improved.

As shown in FIGS. 2 and 3, the motor 40 is fitted directly to the oscillating platen 41 linked at 16 into the spindles 17 and 18 forming an integral part of the casing at two places 19 and 20 of the devices; the need for an inner mounting supporting the mechanism is indeed removed and the casing itself takes the necessary journals.

It should be noted that in this device the clearance of the platen remains the same as that provided for in the related patent referred to hereinabove; FIG. 2 shows the three positions O, O', O'' of the serrated wheel 24 spindle:

O is the rest position;

O' is the position at the end of the engaging movement caused by the spiral cam 21 coming to rest while rotating, on the pin 22 which forms part of the casing 19;

O'' is the position during opening of the can; a stop 23, also forming a part of the casing 19, limits the movement of the arm. This stop may be fitted with a flexible strip 47 which pushes back the oscillating arm into a position where the automatic operation contact is cut as soon as the stresses due to the friction of the cutting element cease.

The mechanism to start the serrated wheel 24 turning is the following:

A worm 26 which meshes with a gear 25 is keyed onto the shaft of the motor 40; this gear consists of two circular parts $25^1$ and $25^2$ which are connected in the plane of symmetry of the worm gear; this connection can be by any known means, for example by boxing 27 for the centres and ultrasonic welding in the peripheral area 28 (FIG. 3). The part $25^1$ turned outwards has a central stud to which is attached the spring 29 which ejects the cutting head; the inner part $25^2$ is fitted with a spindle 30 drilled with a hole of hexagonal section which takes the hexagonal spindle 32 of the cutting head; this spindle 30 ends in a conical housing 31 enabling the spiral cam 21 to be connected by fitting and sticking.

It is no longer necessary, as in the above referenced related patent, to guide the spindle 32 of the serrated wheel 24 through the slot in the support platen 33. Indeed the length of the journal of the spindle 32 in the bore of the spindle 30 is enough to avoid any shift of the serrated wheel when it is working: the radial stresses due to removal of the can lid are shifted from the platen 33 to the serrated wheel 24 by the interposition of the front 19 of the casing and the oscillating arm 41; the axial stresses are passed from the serrated wheel 24 to the platen 33 by washers 34.

The motor is controlled by a switch (FIGS. 2 and 4) consisting of two keys 35 and 36 connected and locked rigidly by a spindle 37 the ends of which fit into the walls of the casing; these two keys which turn the motor in each direction will be of different colours, and the key 35 ends at the bottom in a fork 38 in which two of the segments of the motor reversal and switching system engage; this system works as follows (FIGS. 4 and 5):

"Forward" for removal of throughout lid: the key 36 is pressed to make the contacts between the segments $a_1$-$b$ and $c_1$-$d$; the oscillating arm 41 moves to the O'' position and a pin 39 (FIG. 2) which forms part of the oscillating arm catches the lower ends of the segments b and d in order to keep them in contact with the lower ends of the segments $a_1$ and $c_1$ throughout the removal process; at the end of this, the oscillating arm 41 returns to the O' position and the pin 39 releases the segments which automatically stops the motor.

"Reverse" for withdrawal of the wheel: reversal is achieved by pressing the key 35, which makes the contacts $b$-$c_2$ and $d$-$a_2$. These contacts are achieved by the fact that the segments of the reversing device are trimmed, curved metal parts each forming two segments and their own connection; these segments are fitted top to bottom so as to achieve the connection crossover required for electric reversal of the circuits.

In order to keep the motor running automatically ("forward") the pin 39, acting on the lower part of the segments $b$ and $d$, can be replaced by a lever arrangement shown in FIG. 7: the switch segments are connected to one another by insulating blocks 48, the upper part 49 of the two interpolated blocks being fined down; a lever 50*a* is hinged on the left hand outer block so that, under the effect of the oscillating arm, the end of it 50*b* presses at the level of the top end of the interpolated blocks, in order to limit bending of the segments $a_1$ and $c_1$ to the angle made in the tapered parts 49; in addition, the thicknesses of the interpolated blocks are such that the segments $a_1$ and $c_1$ can make contact with the central segments $b$ and $d$, shifting them slightly, without their being able to come into contact with the segments $a_2$ and $c_2$.

The motor used may be, amongst others, a series universal motor; as this motor has the disadvantage of turning at high speed, a ballast resistor is connected in series, which at the same time has the advantage of not leaving the motor stalled under nominal voltage; as this motor is fitted as described above and shown in FIG. 2, it must be balanced because its weight must not affect the movements of the oscillating arm; to this end, the effect of this weight is compensated by a spring 44 hooked at 45 onto the oscillating arm and supported on a spindle 46 forming an integral part of the casing so as to create an opposing couple.

It can be seen from what has been said that a low clearance flexible segment 47 is provided for, causing the oscillating arm to return from the O'' position to the O' position as soon as the effort of cutting the can lid ceases; after removal of the operating direction, it returns from the O' position towards the O position and the cam 21, from the O position, can catch the pin 22 to position the oscillating arm along the O axis. This method of return has the disadvantage of instantaneously stalling the motor, which can subject the components to abnormal stresses.

It is preferable to remove this disadvantage by replacing the fixed pin 22 by the collapsible device shown in FIGS. 8 and 9.

A pawl 51 with a heel 53 is fitted swivelling about a spindle 52; the heel 53 is stopped by a pin 54 forming an integral part of the casing of the device and a spring 55 constantly tends to bring the pawl 51 back to rest against the pin, when the cam 21 turns in the direction shown in FIG. 8, the spindle holding the serrated wheel shifts in the direction shown by the arrow 56.

When the motor is reversed, the cam turns in the direction indicated in FIG. 9 and the end of the spiral is stopped below the pawl 51 which rises without pushing back the cam. The return to the O position is then obtained only by the wheel disengaging from the rim of the can.

Figures 6, 21:
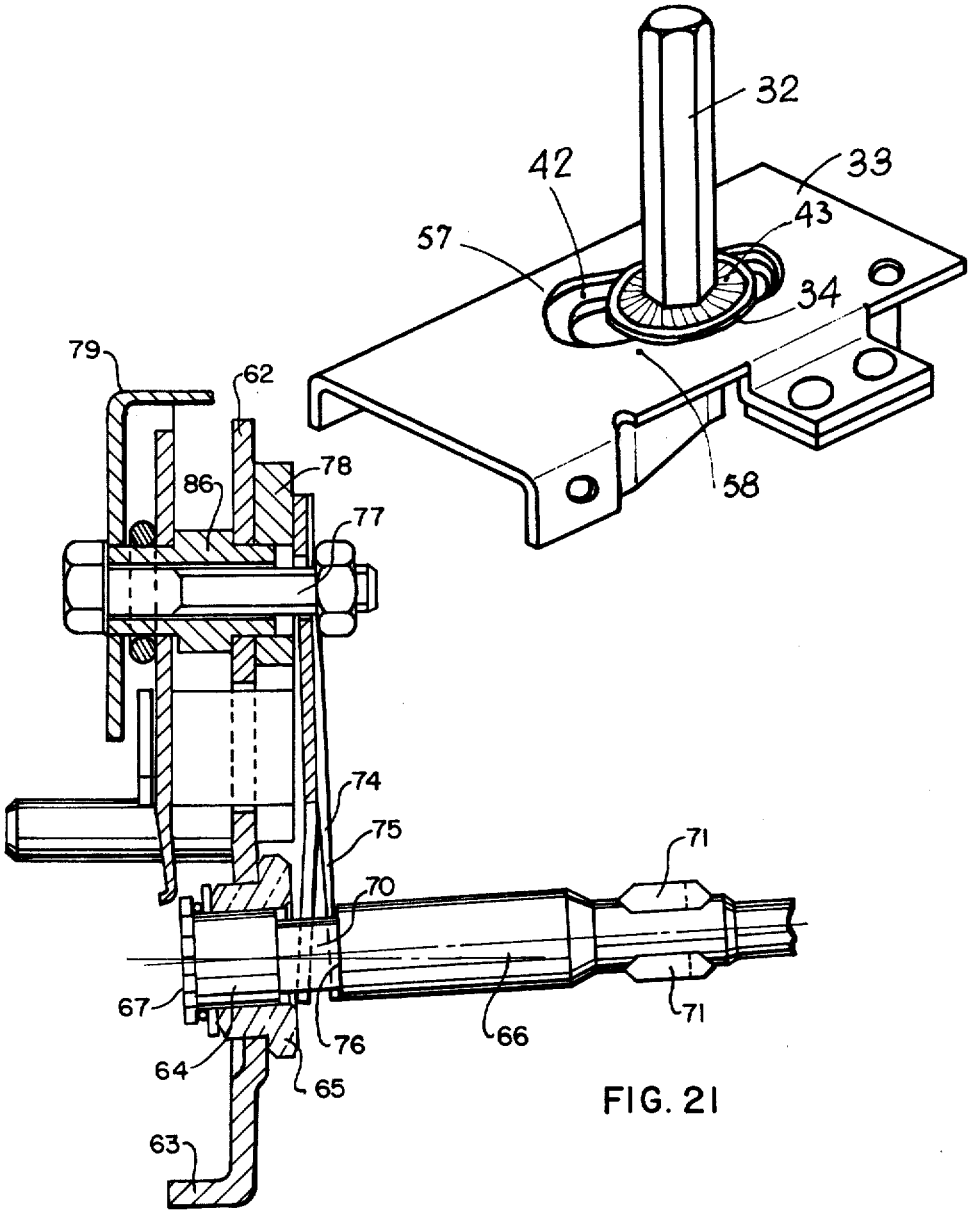
FIG. 6 is a view in perspective of the cutting tool holder platen of the device according to FIGS. 2 and 3.
FIG. 21 is a broken section along the spindle of the lever and the spindle of the serrated wheel of the cutting band showing the inclined angle of the serrated driving gear.

In off-load operation, i.e.: the opening cycle with no can, the absence of a can means that the wheel reaching the O position can no longer come to rest against the rim, there is indeed no disengagement of the serrated wheel which turns freely; since it has to be returned from point O'' to point O, the cutting head is fitted with a friction system such as that shown in FIG. 6.

The hexagonal spindle 32 (see FIGS 6 and 3) takes at its end a lock washer which rests on a head at the end of the spindle which presses the washer 34 on to the rear face of the cutting head; to obtain the desired friction, the lower area 57 adjoining the slot 42 in the platen 33 has been made thinner during stamping with respect to the upper area 58 and the washer 43 has been adjusted so that it cannot be pressed simultaneously onto areas 57 and 58. Consequently, when the spindle turns, there is friction between the washer 34 and the thick area 58, which shifts the spindle along the oblong slot 42 like a pinion engaging in a rack. The friction area is also chosen in such a way that on release, ie: when the spindle turns in the reverse direction, the friction is produced by movement from the O'' position to the O' position.

The head lock washer 43 may be replaced if necessary by the effect of the spring 29 which ejects the cutting head, the force of the spring being chosen to obtain the desired friction.

An alternative embodiment for the device is shown in FIGS. 10 to 20 and consists of a cast casing 59 enclosing the electric motor and the transmission components which are not shown.

The front of this casing holds a more or less rectangular platen 60 kept in position by lateral bolts 61 and 62. The bottom of the platen is bent back and projects to form a stop 63 for positioning the cans.

This platen is fitted with an inclined hollow circular boss drilled with a hole 64 which takes, through the back of the platen, a flanged ring 65 holding the spindle 66 in rotation fitted with a serrated wheel 67 projecting along an inclined angle on the platen as shown in FIG. 21.

This inclination of the serrated wheel enables the can to assume a vertical position resting on the stop, preventing its contents from spilling.

The top of the serrated wheel engages at a tangent with the rim 68 of the can 69.

Figure 12:
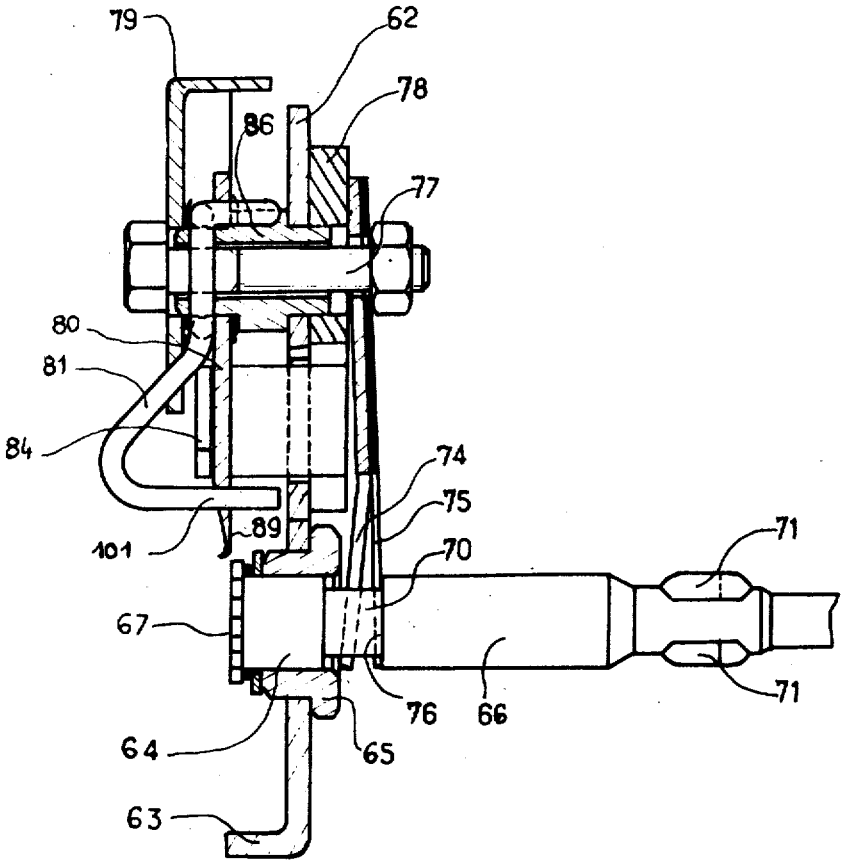
FIG. 12 is a broken section along the spindle of the lever and the spindle of the serrated wheel of the cutting head.

The spindle 66 of the serrated wheel 67 has an annular groove on a sector 70 near the platen and is fitted with turning bosses 71 (FIG. 12).

Figure 17:
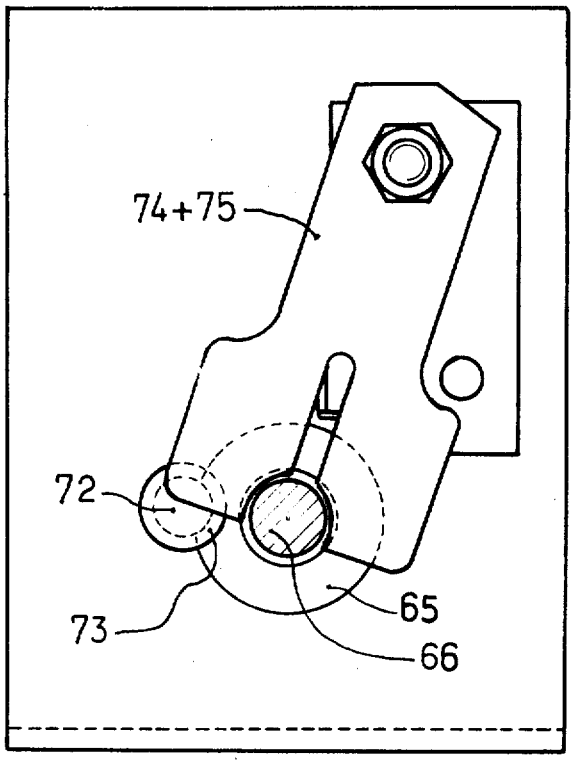
FIG. 17 is a rear view of the cutting head.

A hole in the platen next to the previous one (64) takes a stud 72 one head 73 of which rests against the flange 65 of the ring (FIG. 17).

The flange 65 of the ring and the stud 72 are kept pressed against the back of the platen by the end of an elastic component 74 consisting of a curved metal strip overlapping the spindle sector with the annular groove 70, its other end being bolted to the platen (FIG. 17).

This strip enables the serrated wheel 67 and the stud 72 to move axially.

The axial mobility of the serrated wheel 67 ensures that extra thicknesses on the cans such as welds or dents which push back the serrated wheel can pass through without locking the mechanism.

The purpose of the adjacent mobile stud 72 is to keep cans with straight sides such as sardine cans in the plane of rotation of the serrated wheel by pressure, since these cans have a tendency to go askew.

A second elastic strip 75 placed on top of the previous one on the back of the platen, but not curved, overlaps the sector of the spindle with the annular groove 70 and keeps it in position by pressing on the head 76 formed by the annular grooving, preventing an untimely advance of the serrated wheel 67.

The bolt 77 holding these strips passes through a metal plate 78 which it locks to the back of the platen and comes out on the front of the platen where it forms the axis 77 of rotation of a lever 79, a cutter 80 and an elastic component 81.

This metal plate 78 fixed to the back of the platen has a stop 82 to position the rim 68 of the cans, this stop passing at right angles through the platen and taking a magnet 83 to hold the can lid; this magnet is partly shown.

An angled member 84 forming an integral part of this plate is formed at right angles to the platen 62 by bending and passes through the latter via the slot 85. This angled member 84 is located in front of the serrated driving wheel. This angled member 84 forms the cutter guide component when the lever is pressed on the angled member 84 and the cutter is in the can opening position, giving the latter a high bending strength and establishing for it a precise position with respect to the front of the serrated wheel.

The cutter is rotatably fitted about a top brace 86 and held against the platen by means of the spindle 77. This cutter consists of a flat metal component made of treated steel obtained by stamping and is provided with an angled cutting edge 87. The normal axis of rotation for the cutter 80 with which the edge 87 would be tangent is shown at 88. However, the axis of rotation of cutter 80, about spindle 77, is offset or off-center with respect to the normal axis 88 for edge 87. When the cutter 80 is in the can, the resultant force passes to the inside of the spindle 77, creating a torque, on cutter 80 which tends to engage the cutter 80 in the lid, thus making opening of the can automatic.

In one non-limitative embodiment of the invention, the off-centre position of the axis of rotation for cutter 80 is obtained by using a one piece right angled cutter 80 having a blade portion which has a sharpened edge 87 and a body portion rotatably mounted about the spindle 77.

The cutting edge is sharpened on both sides of the cutter. On the back 89 a bevel 90 is obtained by pressing. This bevel, forming an angle of about 45° enables the removed lid to be lowered towards the inside of the can. In this way, the can, when it is opened, has no sharp projections which may injure. On the front 91, sharpening by metal removal 92 enables the cutting part of the bevel to receive a keen edge. Removal of the metal is such that the thickness of the cutter at the front 93B is greater than at the back 93A. It follows that when the cutter is engaged in the lid, the latter can not rub against the outer face 91 of the cutter. The lid is thus removed without losing its shape and is free from rough edges, as in the case of almost all can openers, both electric and manual.

To prevent the lid remaining attached to the can at the end of opening by the phenomenon of spiral opening, the point of the cutter is bent at 94. When the cutter penetrates, a relatively wide hole 95 is thus made in the lid. At the end of opening as at 96, the cutting edge of the cutter re-engages in this hole preventing the formation of a thin strip of metal attaching the lid to the can.

To enable cans of small diameter or with low radius angles such as oval or rectangular cans to be opened, the back of the cutter is cut away as at 97 so that the part engaged in the cutting path follows it without tending to bump into the side of the rim.

The cutter 80 has a more or less square notch 98 provided therein and a catch 99 extending therefrom, as shown, with the cutter 80 being moved or operated by stop 100 on the starting level 79.

The elastic component 81 is rotatably fixed on the same axis of rotation 77 as that of the cutter.

This elastic component consists of a metal pin bent back on itself. One of the arms is ring shaped and swivels about the spindle 77.

The end 101 of its lower arm is bent at right angles to the platen 62.

An undulation 102 in the upper arm of the aforesaid pin 81 fits within the notch 98 of the cutter 80 and rotation of pin 81 under the effect of the lever 79, positions the end 101 of the pin on the rim 68 of the can. Since the notch 98 is larger in size than the section of pin 81 which fits therethrough, pin 81 has a range of movement of rotation about spindle 77 as limited by the top and bottom of notch 98 and thus with respect to the cutter 80.

During the cutting operation while the can 69 is rotating, the top of notch 98 forcibly presses the pin 81 against can 69 thereby helping the serrated wheel 67 turn the can 69. However, since pin 81 has a range of movement within notch 98, extra pressure can be placed on the top of can 69 by pin 81 by pushing lever 79 downwardly until stop 103 on lever 79 engages pin 81. Further pressure on lever 79 will thereby be transmitted to can 69 so as to, for example, correct dragging of the serrated wheel or ease passage over hard points.

The starting lever, by lowering onto a contact maker 104 fitted with a return spring and projecting onto the casing, is fitted on the spindle 77 along with cutter 80 and pin 81 by the interposition of the tubular brace 86 and is used as a driving component of the cutter 80 and of the spring pin 81.

The lower stop 100 of the lever is placed during fitting between the catch 99 of the cutter and the top of the cutting edge 87.

By pressure on the back of the cutter when the lever is descending onto the starting contact maker, stop 100 pushes the end of the cutting edge 94 onto the lid. The distance between the catch 99 of the cutter when the cutting edge is in the can and this stop 103 determines the sector of free rotation of this cutter and enables rotation to be stopped by raising the lever without the cutting leaving the can which is held on the device between cutter and wheel.

This stop 100 of the lever enables the cutter to be released by raising it when rotation is stopped.

The serrated wheel bearing shaft 66 is turned by two studs 71, obtained by metal flattening, which work in combination with two other studs 105 in the housing 106 made in the driving hub 107. This arrangement forms an alternative coupling to the hexagonal one described in the main patent, which has the advantage that it can be made from a round steel section, less expensive than hexagonal sections.

When the serrated wheel bearing spindle 66 is assembled in the housing 106 and in order to facilitate the enagement of the studs 71 with their opposite numbers 105, they are each canted 108 and 108'.

Figure 10:
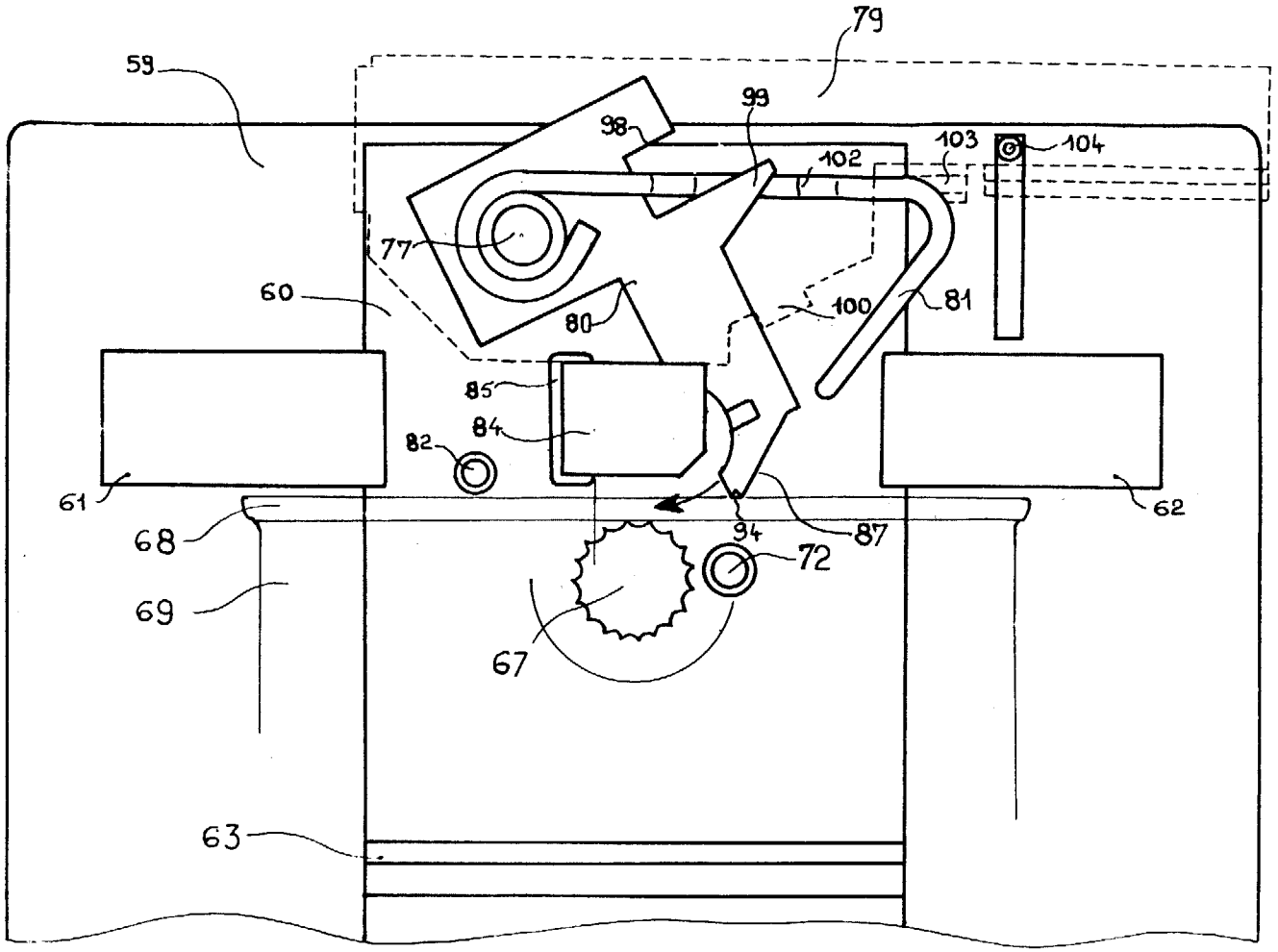
FIG. 10 is a front view of the upper part of an alternate form of the device, the operating lever being shown by a dotted line and the can to be opened by a thin continuous line. The device is at rest.

To sum up, the operation of the can opener just described is as follows:

The rim 68 of the can 69 is placed against the positioning stop 82 and above the serrated wheel 67 (FIG. 10).

Figure 11:
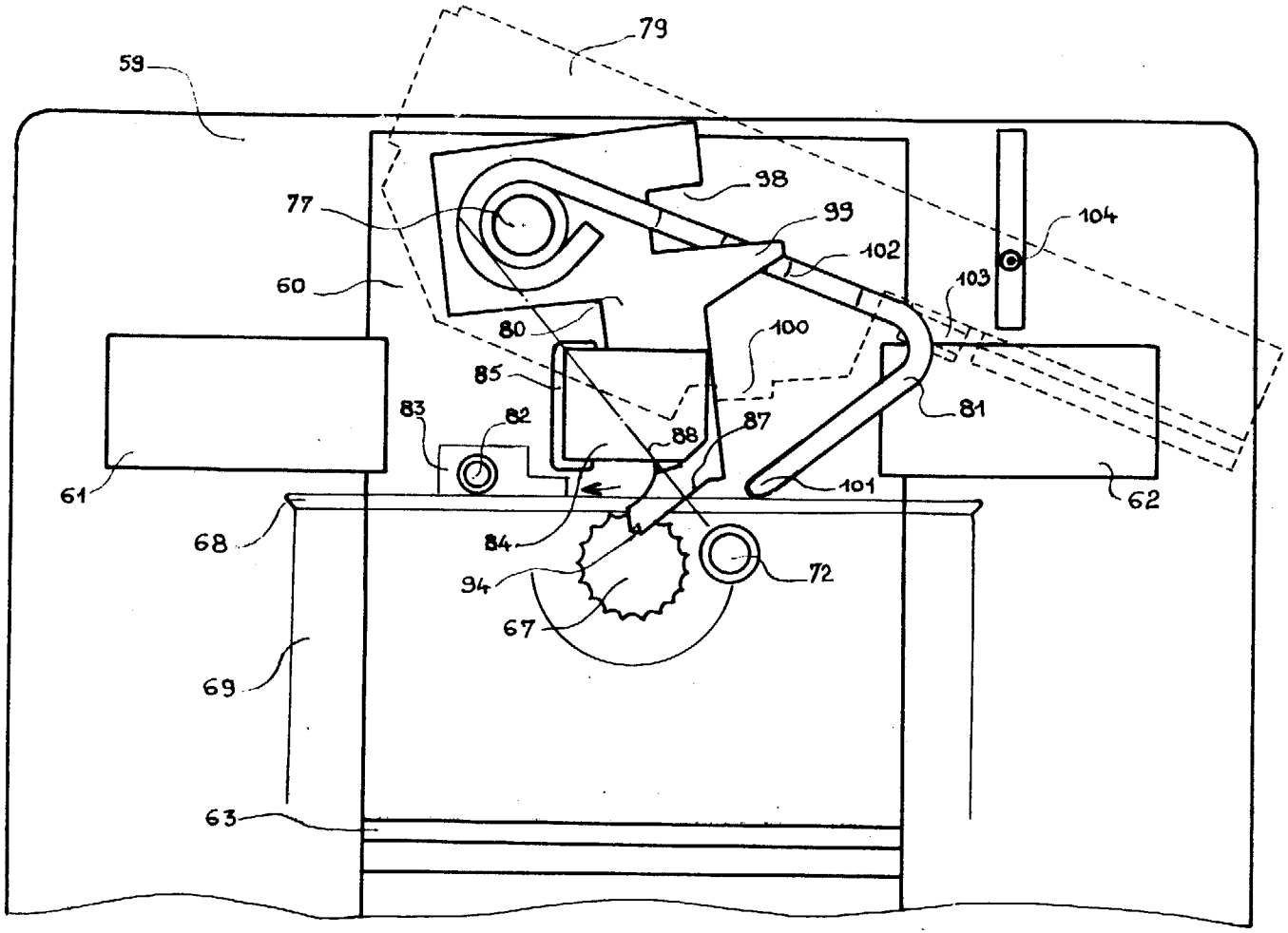
FIG. 11 is the same view of the device but during removal of the lid of the can to be opened.

Lowering the lever onto the contact maker, because of their connection, positions the end of the cutting edge 94 of the cutter on the lid and the spring pin 81 on the can rim; at the same time it closes the contact, and the serrated wheel turns the can 69 (FIG. 11).

The rotation of the can drives the point 94 to penetrate into the lid until the cutter locks in the cutting position in the angle 84 held by the platen. Passing through its free rotation sector, the cutter braces against pin 81 and presses pin 81 with the top of notch 98 onto the rim.

Owing to the axial mobility of the serrated wheel, extra thick parts of the can pass between the serrated wheel 67 and the cutter 80 without locking the device. In the case of cans with straight pieces, the stud 72 next to the serrated wheel exerts a pressure which holds them in the serrated wheel's plane of rotation.

At the end of opening, the magnet 83 fitted to the positioning stop 82 prevents the lid from falling into the tin. The user stops rotation by releasing the pressure on the lever which moves up under the effect of the contact maker return spring, without the cutter coming out of the angle, not releasing the can which is held locked between cutter and serrated wheel.

The can may then be removed from the can opener by raising the lever, the lower stop of which moves the cutter and releases the can.

The can opener in the present invention enables all types of food can to be opened very efficiently with no manual effort. Because of the axial mobility of the serrated wheel, cans which have been knocked on their crimping rim or with extra thickness at the welds may also be opened.

I claim:

1. In an electrically operated can opener of the kind having an electric drive motor, a cutting member, an operating lever pivotally mounted to said opener about a fixed axis so as to be movable between operating and non-operating positions, can drive means drivingly connected to the drive motor for rotating the can and can positioning means for positioning the can, the improvement comprising:

rotatably mounting said lever, cutting member and an elastic element about the same fixed axis so that each is independently movable with respect to each of the others, wherein said cutting member having a cut-out portion defined by top and bottom edges and at least one side edge, said elastic element being positioned and movable within said cut-out portion, said lever having first and second stop members to respectively engage said elastic element and said cutting member wherein the rotation and movement of the elastic element into an operating position is controlled by said first stop member, the movement of the elastic element during operation is under the joint control of one of said first stop member and said top and bottom edges, while the rotation of said elastic element to a non-operating position is controlled by the bottom edge of said cut-out portion and wherein the rotation and movement of said cutting member between operating and non-operating positions is controlled by said second stop member.

2. Device according to claim 1, characterised by the fact that the axis of rotation of the cutting member is off-set from the perpendicular drawn from a cutting edge of the device in such a way that the resulting cutting force tends to engage the cutting member in the lid of the can.

3. Device according to claim 1, characterised by the fact that the can drive means includes a serrated wheel mounted on a spindle capable of elastic axial movements in a direction which tends to increase the distance between cutter and serrated wheel.

4. Device according to claim 2, characterised by the fact that the cutting member has a sharpened front cutting edge, said front cutting edge being angled so that the cutter is backed-off with respect to the cut edge of the lid.

5. Device according to claim 2, characterised by the fact that the point of the cutting member is bent so that when the lid is penetrated, a hole wider than the normal cutting path is made.

6. Device according to claim 2, characterised by the fact that the back of the cutting member is shaped in such a way that the section of this cutter to the right of where the lid is cut is roughly the same as in the zone next to its point.

7. An electrically driven device for opening a can comprising case means for enclosing said device, a platen fixed to said case means, said platen having mounted thereon a positioning stop to maintain the position of said can; a serrated driving wheel to rotate a can, said driving wheel mounted on drive shaft means mounted within said case means for driving said driving wheel; lever means rotatably mounted on said platen for activating said device and controlling the opening of said can, said lever means being movable between operating and non-operating positions; a cutting element mounted in axial alignment with said lever; a resilient element rotatably mounted in axial alignment with said lever and said cutting element wherein said cutting element is provided with a notch in which said resilient element is positioned, and an extension arm, said notch being larger than said resilient element so as to allow said resilient element to move therein and wherein said lever is provided with first and second stops spaced apart circumferentially on said lever, said first stop for engaging said resilient element so that when said lever is moved to said operating position said first stop engages said resilient element, said second stop engaging said cutting element when said lever is moved into said operating position so as to move said cutting element onto said can and wherein said second stop engages said extension arm when said lever is moved to said non-operating position so as to raise both said resilient element and said cutting element.

8. An electrically driven device for opening a can as claimed in claim 7 wherein said device includes electrical contact means projecting into the path of movement of said lever for turning said device on and off.

9. An electrically driven device for opening a can as claimed in claim 8 wherein said contact means is activated by said lever after said cutting element enters said can.

10. An electrically driven device according to claim 7 wherein the axis on which said cutting element is mounted is off-set with respect to the perpendicular drawn from a cutting edge of the device such that the resulting force creates a torque which tends to maintain engagement of said cutting element in the lid of the can.

11. An electrically driven device according to claim 10 wherein said cutting element has sharpened front and rear surfaces.

12. An electrically driven device according to claim 10 wherein the cutting element is sharpened so that the thickness of said element tapers away from a front cutting edge.

13. Device according to claim 10 wherein the portion of said cutting element which first enters the lid of said can is shaped so that when the lid is penetrated, a hole wider than the normal cutting path is made.

14. An electrically driven device according to claim 7 wherein said resilient element is comprised of a pin having two shaped arms, one of said arms being positioned within said notch, the other of said arms being positioned so as to rest on the rim of the can during the cutting operation so as to press said rim against the serrated driving wheel.

15. An electrically driven device according to claim 7 wherein the drive shaft on which the serrated driving wheel is mounted is axially movable in a direction away from a normal operating position which tends to increase the distance between said cutting element and said serrated driving wheel and wherein said device further includes spring means for maintaining said drive shaft in its normal operating position.

16. A device according to claim 7 wherein said drive wheel is mounted at an inclined angle with respect to said platen.

* * * * *